US007526893B2

(12) United States Patent
Thoele

(10) Patent No.: US 7,526,893 B2
(45) Date of Patent: May 5, 2009

(54) METHOD AND DEVICE FOR ASSEMBLING A GRID OVER THE OPENING OF A FLORAL VASE/CONTAINER

(75) Inventor: Catherine Marie Thoele, Chesterfield, MO (US)

(73) Assignee: Catherine M. Thoele, Chesterfield, MO (US)

( * ) Notice: Subject to any disclaimer, the term of this patent is extended or adjusted under 35 U.S.C. 154(b) by 639 days.

(21) Appl. No.: 11/104,108

(22) Filed: Apr. 12, 2005

(65) Prior Publication Data

US 2006/0225343 A1 Oct. 12, 2006

(51) Int. Cl.
*A47G 7/07* (2006.01)

(52) U.S. Cl. ..... 47/41.11; 47/41.01

(58) Field of Classification Search ..... 47/41.01, 47/41.11, 41.13, 41.14, 41.15, 41.12; 428/23, 428/27; 248/27.8; D11/143, 144, 152, 153, D11/146, 147

See application file for complete search history.

(56) References Cited

U.S. PATENT DOCUMENTS

| | | | | |
|---|---|---|---|---|
| 522,910 | A * | 7/1894 | Marston | 24/6 |
| 3,793,126 | A * | 2/1974 | McAdams | 428/24 |
| 4,331,721 | A | 5/1982 | Ayers | |
| 4,958,461 | A | 9/1990 | Aldrich | |
| 4,964,237 | A | 10/1990 | Specht | |
| 5,127,184 | A | 7/1992 | Cosentino | |
| 5,142,820 | A | 9/1992 | Aquino | |
| 5,375,370 | A | 12/1994 | Zimmerman | |
| 5,477,637 | A | 12/1995 | Aldrich | |
| 5,758,452 | A | 6/1998 | Matteucci et al. | |
| 6,189,261 | B1 | 2/2001 | Helgeson | |
| 6,389,744 | B1 | 5/2002 | Pugh | |
| 6,523,301 | B2 | 2/2003 | Delaney | |
| 2002/0184818 | A1 | 12/2002 | Roskin | |

FOREIGN PATENT DOCUMENTS

| | | |
|---|---|---|
| DE | 2261148 | 6/1974 |
| DE | 2648962 | 5/1978 |
| EP | 694275 | 1/1996 |
| FR | 2626158 | 7/1989 |
| GB | 2147205 | 5/1985 |

OTHER PUBLICATIONS

"The Great Arranger Grid" by Bellizsima Floral Products Co, USA. Floral Management Magazine/ Feb. 2004 p. 35/ www.safnow.org. Rigid Plastic Cap Type Grid sold by Stenson Floral Supply Co.

* cited by examiner

*Primary Examiner*—T. Nguyen

(57) ABSTRACT

A method and device for preparing a vase to hold a flower arrangement which is comprised of a waterproof net covering the top opening of the vessel; an elastomic sleeve which is a means to temporarily shape and hold the netting in place; and a strip of floral adhesive which is a means to secure the netting to the outside rim of the opening. The floral stems are guided through the plurality of apertures to form an arrangement that can be safely handled and delivered without loosing its shape.

2 Claims, 7 Drawing Sheets

METHOD AND DEVICE FOR ASSEMBLING A GRID OVER THE OPENING OF A FLORAL VASE/CONTAINER

CROSS-REFERENCE TO RELATED APPLICATIONS

Not applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to the process of gridding vases/containers, specifically to such vases/containers which are used by hobbyists and professionals alike to assist and expedite the development and shape of a floral arrangement and to assist in securing the original shape of the arrangement during handling, delivery and installation.

2. Prior Art

Retail florists commonly begin an arrangement by placing a criss-cross pattern of floral adhesive tape across the opening of the vessel, over the lip and down approximately ¼ inch to ½ inch onto the outside of the chosen vessel. The grid is then secured to the vase by tightly wrapping another piece of floral adhesive tape around the outside circumference of the lip of the vessel to bind the tape endings to the outside rim of the container, thus holding the grid work in place.

The size of the voids created by the grid is determined by the preference of the floral designer. Some designers prefer a grid with larger, fewer apertures. While others prefer a smaller, tighter net. Consequently, the ability to vary the size of the apertures and the ability to adapt the gridding to many different sizes and shapes of containers are two very important qualities.

Such a grid is an important means of keeping the stem insertions in place while the arrangement is being developed. The grid also assists in keeping the stems in place during the jostling of the finished product during the delivery process and the installation of the floral piece to its final destination. The strength and durability of the grid is obviously also very important.

Originally the reticular of tape was applied by hand, one piece at a time; first as strips of tape in one direction across the opening. Then, repeating the process in the opposite direction across the opening to eventually form a reticular or fish net pattern of tape over the entire opening. The ends of the strips are bent down over the lip and onto the outside edge of the opening. The net of tape is secured by manually running another piece of adhesive tape very tightly around the outside edge of the container/vase. In essence, the net of tape supports the stems and helps to keep the stems from flopping around during the process of building the arrangement and also during the delivery and installation processes.

Industry professionals commonly use two different styles of floral adhesive tape. The two most popular adhesives are:

#1-a clear scotch tape style

#2-a floral tape that is solid dark green on the outside surface with a white adhesive underneath.

Both are produced on rolls 100 yards long. Both are available in two widths. Size A is ¼ inch wide. Size B is ½ inch wide and is generally used for vases/containers with very large openings. The dark green tape has a stronger adhesive, remains bonded longer and holds up better when exposed to water in the container and the humidity and moisture in the flower coolers. It is flawed, however, by the fact that the finished grid is more difficult to camouflage than the clear adhesive one. An important consideration in professional designing is to not allow the mechanics of this type of an arrangement to show. The clear adhesive is easier to hide but does not have the adhesive strength of the dark green tape and doesn't perform as well once the water and moisture are introduced into the mix. In both cases the grid is at risk of collapsing once the vessel is filled with water. The dark green tape is, however, more durable.

Literally thousands of vases are hand-taped in shops worldwide every year. While the cost of the materials used in the hand-taping method amounts to only pennies per container the tape is susceptible to moisture damage, and the process is very time consuming.

A designer or designer's assistant with average skill and experience can hand tape approximately 30 vases per hour. Consequently the hand-taping method monopolizes many hours of expensive labor.

To date, other inventors have suggested alternatives. Such as:

#1 A complicated series of rubber bands, too complicated and too time consuming to be productive and profitable and not strong enough to support an arrangement or survive delivery.

#2 A flexible grid formed from woven pipe cleaners which is not secured to the vessel, difficult to camouflage, more time consuming to construct and truly pointless in effect because there is not enough strength in the grid to be of assistance.

#3 A plastic closure that is too rigid to design in, too limiting to the sizes of stems that it will receive, too limiting to the types of vases/containers that it will fit, too difficult to camouflage and too expensive to use profitably.

#4 A pre-apertured page of adhesive with tabs around the perimeter is too weak to adhere to the vessel, too limiting on the size of stems it will accept, too difficult to camouflage, too expensive (sometimes costing as much as the vase/container) to use profitably, too susceptible to moisture, too difficult to apply and has definite size limitations.

To date, inventors have suggested 4 alternatives to the primitive hand-taped method.

#1 In the U.S. Pat. No. 6,189,261 the floral arranging accessory that is proposed is designed out of pipe cleaners that are not secured to the container well enough to be used commercially and is also intended to be removed from the finished arrangement. Thus being of no asset in helping to hold the floral materials in place during delivery. This method also appears to be even more time consuming to install and virtually impossible to keep in place while the designing of the arrangement is taking place. It might be of some minor assistance to a hobbyist who has all day to develop an arrangement but, from a professional standpoint U.S. Pat. No. 6,189,261 flexible arranging grid is mainly a toy and would not be acceptable in a commercial setting.

#2 Other problems associated with prior art grids like the ones suggested by in U.S. Pat. No. 5,578,452 are that the plastic cap type grid is too rigid, does not adapt well to the wide variety of shapes, sizes and styles of containers and is difficult to camouflage around the edge of the vessel as well as throughout the lid. The rigidity and size of the apertures limits the size of the stems and consequently the selection of the types of flowers that can be used. The size of the openings is not adjustable to the many different sizes of stems. The plastic cap type grid is also too rigid and doesn't afford the designer the ability to make insertions at different angles which is often necessary to achieve the proper shape and/or camouflage the mechanics (ie. the grid itself).

#3 Furthermore, the grid presently on the market that is a pre-aperatured page of adhesive with tabs around the perimeter allows for a limited diameter stem to be inserted. The manufacturer of the adhesive page grid recommends that you wait 20 minutes after application for the adhesive to set, while our invention is ready to use in seconds. The tabs are difficult to camouflage once they are stuck to the sides of the vase/container and it is difficult to remove the residue once the arrangement is dismantled.

#4 An application (W2002/0184818) is also pending that suggests a floral grid be made out of elastic and stretched over the top opening in the vase. Again, while possibly an aid for the hobbyist, this is not something that would work in commercial floristry. An elastic lid would be too difficult and too time consuming to use effectively with any speed. Each stem insertion would encourage the device to peel off the edge of the vase. If it were left on it would rarely stay on through the jostling of the delivery process. If it were removed before delivery, as the applicant suggests, the flowers would not maintain their placement during the delivery process and chances are a jumbled mess would be delivered instead of a carefully designed arrangement. It would rarely survive delivery. The fact that it is easily removable makes it worthless and a hindrance to product delivery. Commercially speaking we do not want a device that we can reuse. Our mechanics must go out the door with the arrangement. They must be easily camouflaged and need to be disposable after the flowers are spent. Like the plastic lid type grid, the elastic grid is much too expensive to be profitable. Like the plastic lid type grid, the elastic grid is also too difficult to camouflage. The care and handling instruction card that accompanies every arrangement instructs the recipient to "add water daily". Like the plastic lid type grid, the elastic grid is too difficult to add water through.

OBJECTS AND ADVANTAGES

A need therefore exists for a method of accessorizing a wide variety of sizes, shapes and styles of floral containers with a design grid in an economical, time efficient fashion for needs specific to professional floristry use. The grid needs to be economical, time and labor efficient, water/moisture resistant, maintain its strength during delivery, be easily camouflaged, have adjustable sized apertures, be strong enough to withstand the designing process and the delivery process and flexible enough to be manipulated by the insertion angles when necessary.

This proposed invention is a device and method for preparing a floral container to receive a floral arrangement. The device, while most effective and attractive in a commercial use can be enjoyed by professionals and hobbyists alike. The device includes a grid cover made from a sheet of plastic netting which is placed on top of the vessel, and an elastic band that is applied over the netting and down around the edges of the container to temporarily hold the netting in place. The method also uses a piece of floral tape that has a high tensile strength. The tape is wrapped tightly around the outside edge of the vessel to secure the overlapping plastic netting to the side of the vase (much the same way that the tape tabs are secured to the vessel in the hand-taped method of gridding a vase). A smaller, tighter grid can be accomplished by applying a second piece of the polypropylene/plastic netting across the middle of the openings of the original piece. A second elastic band is applied over the top of both pieces to hold the second layer in place. Floral tape is used to secure the second piece. The band or bands are removed by pulling them back over the top of the container or down to the bottom of the vase and off the bottom (whichever the designer prefers). The excess netting is trimmed off with an ordinary household scissors (similar to the way tape tabs are trimmed in the hand taping method). The designer has the ability to snip a piece of netting out at random locations, without weakening the overall grid, (as would happen with some of the other methods) to enlarge an opening for a larger stem (ie. Calla lily) and still keep the small tighter plurality in tact.

SUMMARY

This method is economical. The netting is less expensive than the tape and this polypropylene fabric has never been used as a gridding material in floristry heretofore. The other methods are much more expensive than the hand taping method. The threads of netting are thinner than the other materials the other grids mentioned thus availing more surface space to the designer while still remaining as strong or stronger than the other methods. The netting is much easier to camouflage than any of the other methods. This invention is readily adaptable to all shape, sizes and styles of containers. The netting, which is water/moisture resistant, is more advantageous to the designer because the design surface is larger and the threads of netting are more flexible than the thicker strips of plastic, cardboard, tape or elastic. The grid will stay strong and functional throughout the designing process as well as the delivery process. The elastic band is also economical and can be reused hundreds of times. The band can be produced in several sizes to accommodate jumbo containers as well as unusual shaped ones. By using this method to grid a vase the job can be accomplished much faster than the hand taped method and is more economical, more adjustable, more flexible, more deliverable, easier to camouflage and consequently more overall accommodating than the other methods mentioned.

DRAWINGS

Figures

For a better understanding of the present invention reference is made to the following description of exemplary embodiments thereof, considered in conjunction with the accompanying drawings, in which;

FIG. 1A shows a piece of plastic poultry netting

FIG. 1B shows a roll of floral tape.

FIG. 1C shows the elastic sleeve or band (shown here in three sizes) lying on a table.

DRAWINGS

Reference Numerals

Figure 1A:
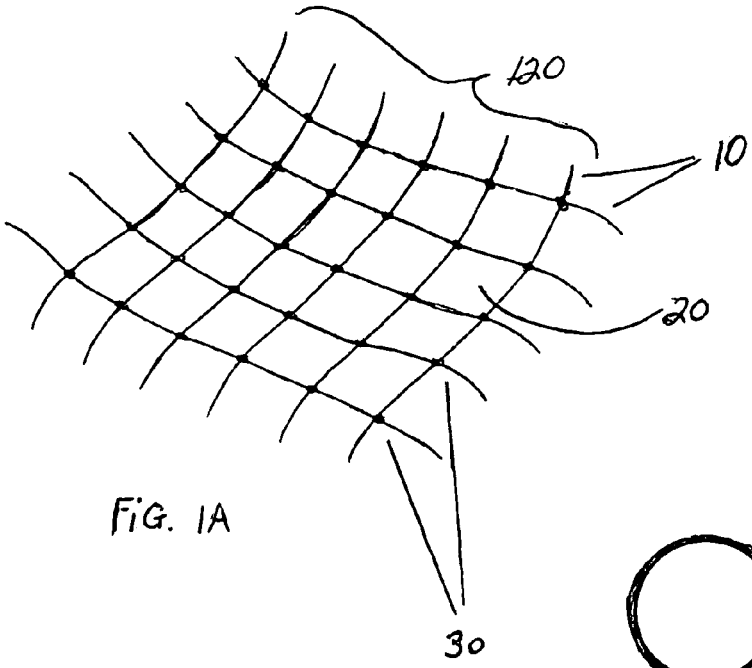
FIGS. 1A-1C show the components of the invention.
Figure 1B:
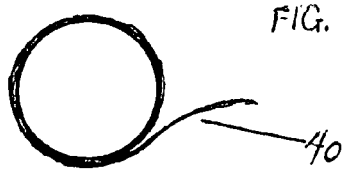

10 threads of plastic that make up the polypropylene netting
20 apertures or holes in the netting
30 plastic reinforced corners where the threads are joined to form the netting
40 strip of floral adhesive tape that has been pulled off of the roll
50 seam where the sleeve is fused together
60 opening of the sleeve
70 elements of a floral arrangement
80 generic vase
90 outside edge of the vase
100 simple household scissors
110 elastomeric sleeve
120 polypropylene plastic netting

DETAILED DESCRIPTION OF THE INVENTION

Although the present device and method can be used to orient an elongated object within a receptacle such as florist wire, pens and pencils etc., the present invention is particularly well suited for retaining cut flowers in a vase. Consequently the present invention is described in an application where it is used to hold flowers in a vase in order to set forth the best mode contemplated for the invention.

Referring to FIG. 1A, an embodiment of the plastic poultry netting showing the thin threads of plastic (10), the reinforced corners (30) and the plurality of the apertures (20) through which the floral elements (70) are guided.

Figure 1C:
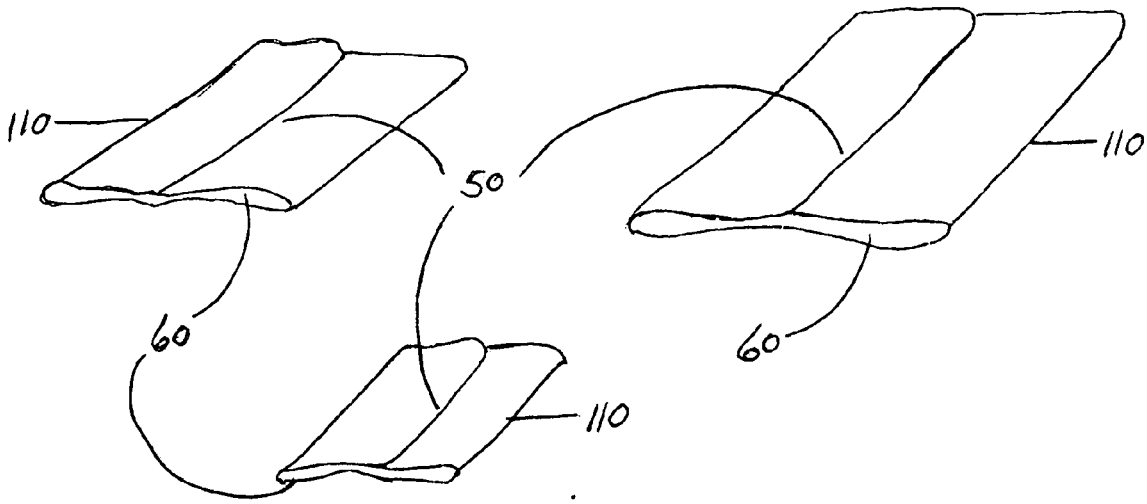

The netting (120) is made of a flexible, pliable, polypropylene material and can easily be bent over the top edge of the vase (80). Through the application of the elastomeric sleeve (110), both the netting (120) and the sleeve (110) can be encouraged into many different configurations. The sleeve can be manufactured in several different sizes (FIG. 1C) to accommodate a wide variety of different containers (FIGS. 12A-12C). The vase (80) is of a traditional construction, having a circular open top. However, it should be understood that the application of this invention to countless sizes, shapes and styles of containers can easily be accomplished as shown in FIGS. 12A, 12B and 12C.

Figure 4:
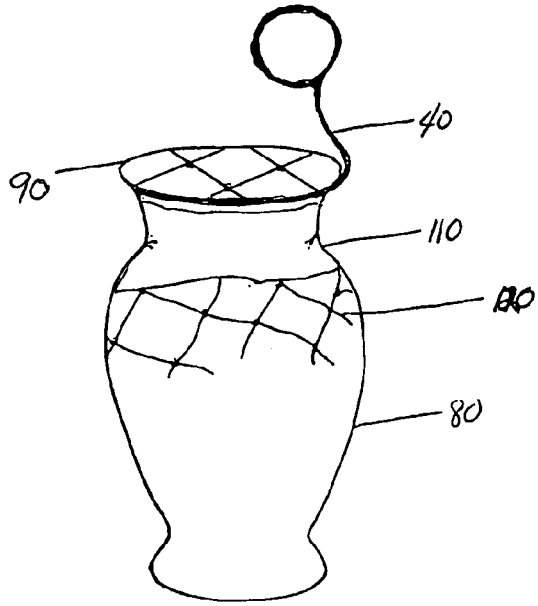
FIG. 4 shows the floral tape being applied tightly around the rim of the vase to hold the netting in place.

The roll of tape (40) is shown in FIG. 4 in conjunction with the vase (80) and the netting (120) to demonstrate to the reader where and how this component is applied. It is applied to the very top outside edge (90) of the vase and holds the netting in place.

Figure 2:
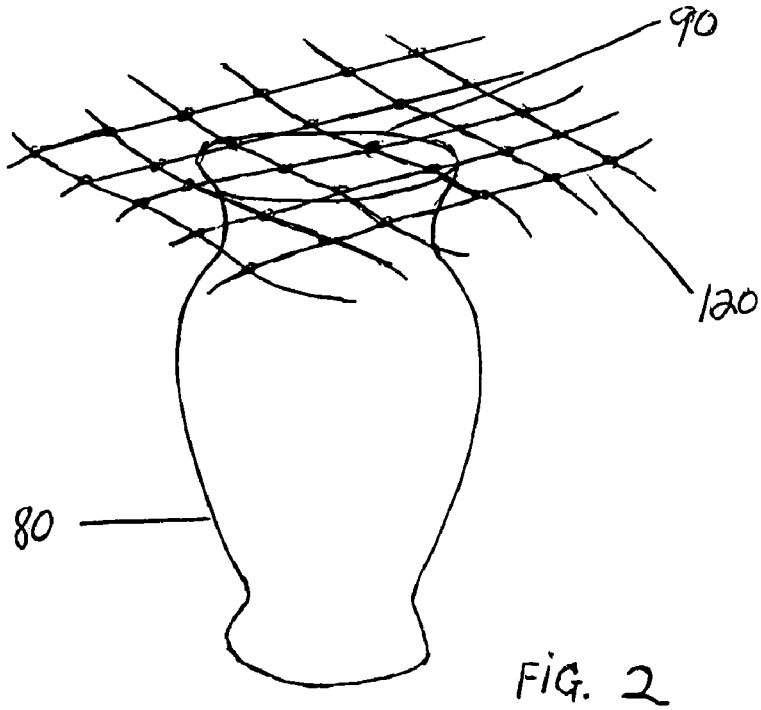
FIG. 2 shows a generic flower vase with a piece of the polypropylene plastic netting lying over the top of it.

FIG. 2 was included in the drawings to illustrate the conjunction of the vase (80) and the netting (120). This is the first step of the process.

Figure 3:
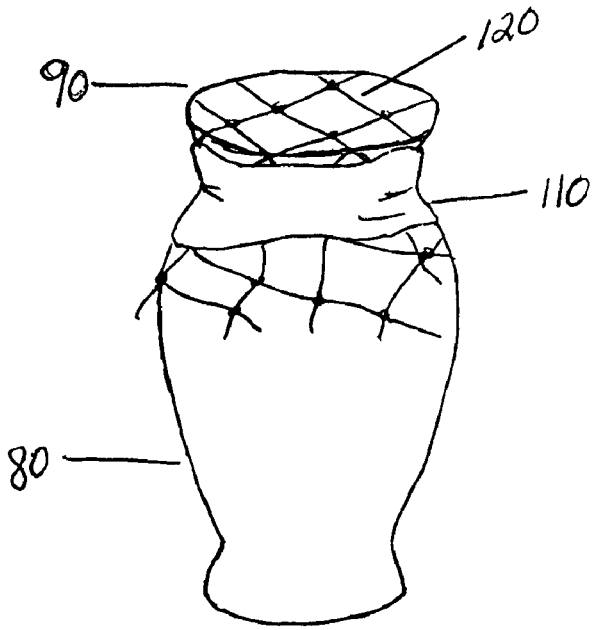
FIG. 3 shows the elastic sleeve fitting snuggly over the neck of the vessel, conforming to the shape of the vase and holding the plastic netting temporarily in place.

FIG. 3 illustrates the elastomeric sleeve (110) in its' applied position around the shoulders of the vase (80) where it is temporarily holding the netting (120) firmly but not too tightly over the edge (90) of the vase. This is where the sleeve stays until the application of the piece of floral adhesive (40) around the outside edge (90) of the vase is completed as shown in FIG. 4.

Figure 5:
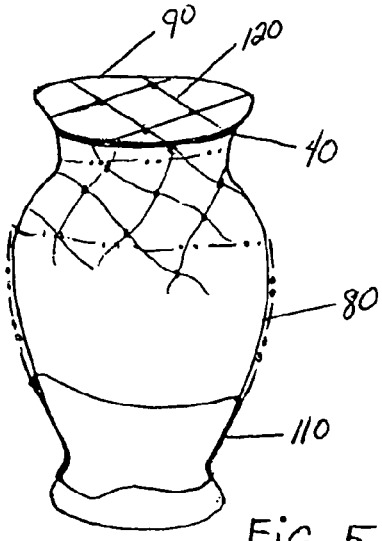
FIG. 5 shows the elastic band pushed down to the bottom of the vase so that it can be easily removed.

FIG. 5 demonstrates the removal of the elastic band (110) by displaying the band (110) at the bottom of the vase (80), ready to be removed from the bottom of the vessel. The elastic band (110) can be removed easily by pulling it up over the top or down and off the bottom from a variety of shapes, sizes and styles of containers. Even if the top of the vase is small and the bottom of the vase is large as shown in FIG. 12A, or vice versa, the elastic band can accommodate the change in size and be removed easily. Once removed the sleeve (110) can be reused on another container and then another and another.

Figure 6:
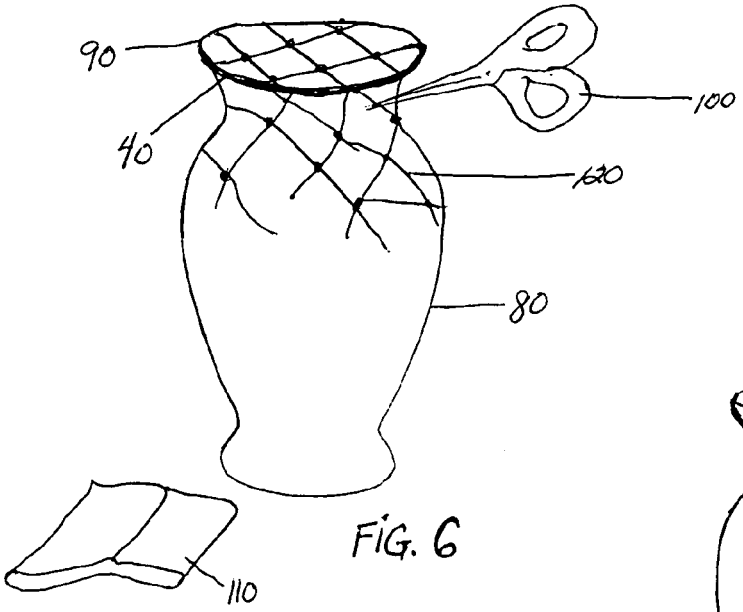
FIG. 6 shows the excess netting being trimmed away from the vase and the sleeve lying off to the side.

FIG. 6 shows the excess ends of the netting (120) and how they are easily trimmed off with a simple house hold scissors (100). No special tools are required for this job as often a special heavy duty cutter is required to trim the conventional metal chicken wire commonly used in professional floristry in other various capacities.

Figure 7:
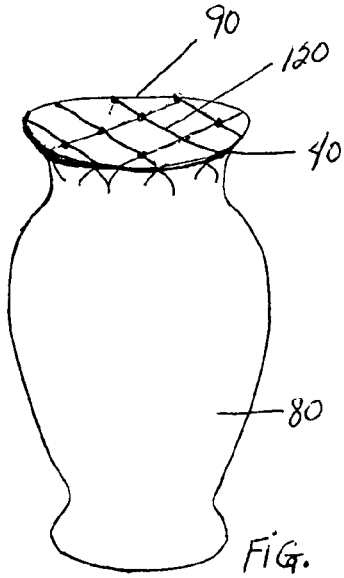
FIG. 7 shows the finished process.

FIG. 7 shows the finished process with all the components in place.

Figure 8:
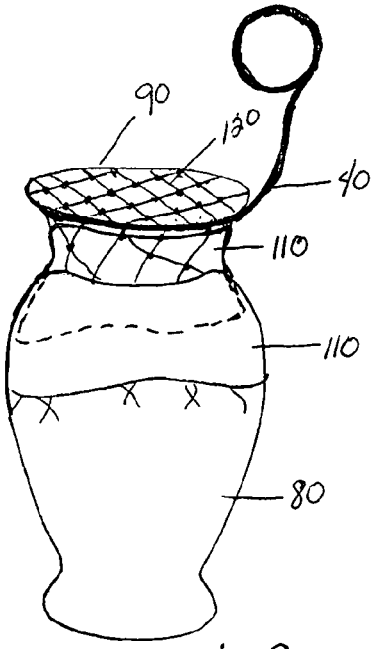
FIG. 8 shows a second piece of netting and a second sleeve being applied.

FIG. 8 shows an important option of this method. In a shop or design center filled with different types of designers it is often an issue that some designers want larger apertures in their grids while others prefer smaller holes. This invention can accommodate both requests by simple adding a second piece of netting (120) to the top of the first piece and aligning it to divide the first plurality of apertures with the threads (10) of the second piece of netting (120). Apply a second sleeve (110) to hold the second piece of netting (120) in place. Then tape a second time around the perimeter of the vase. Remove the second sleeve just as you did the first and trim the excess. The two pieces of netting (110) can be applied simultaneously or the second can be added days or weeks after the first grid application which is another advantageous characteristic of this invention.

Figure 9:
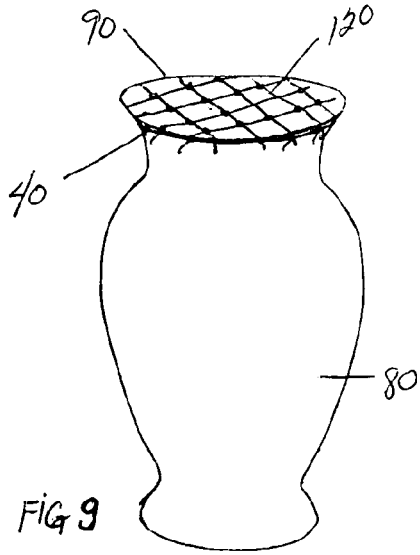
FIG. 9 shows a smaller, tighter grid on the vase.
Figure 10:
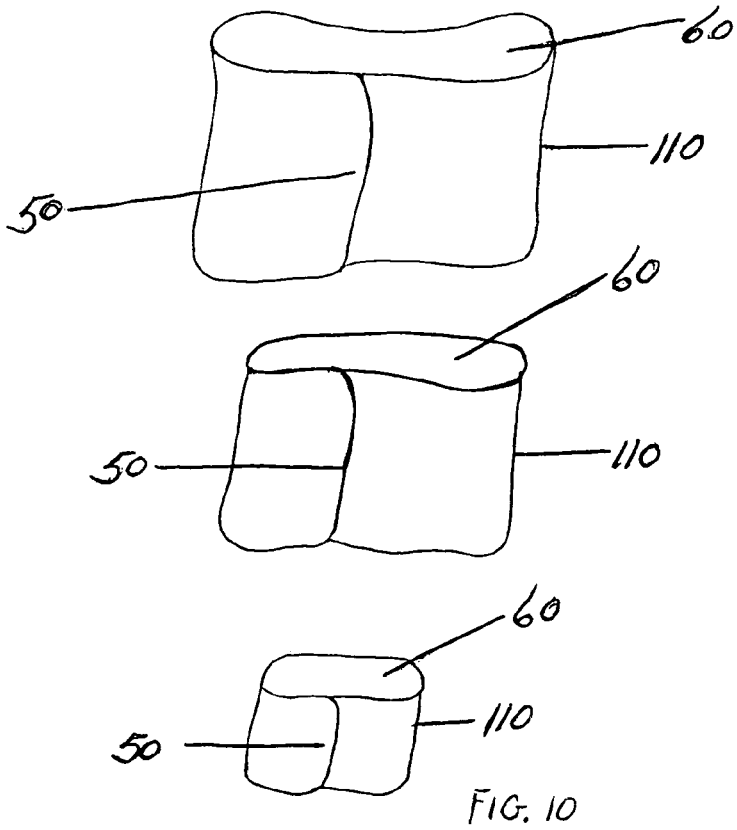
FIG. 10 shows a frontal view of the elastic sleeve in 3 sizes.

FIG. 9 shows the smaller apertures and the increase in the plurality of the grid FIG. 10 shows a view of the elastic sleeve (110) as if it were standing on one end. It also shows the possibility of making the sleeves in different sizes. The FIG. 10 drawing is also intended to express the fact that the sleeve (110) is soft and pliable, easy and light weight to ship, easy to package because they fold down flat, and easy to merchandize. The seam (50) on the sleeve is shown in FIG. 10 so that you could understand its structure. A seam (50), however, would not be imperative if the manufacturer had a way to fuse the fabric into one continuous piece. The sleeve (110) is launderable and the different sizes could be manufactured in different colors so as to be easily identified in the work place.

Figure 11:
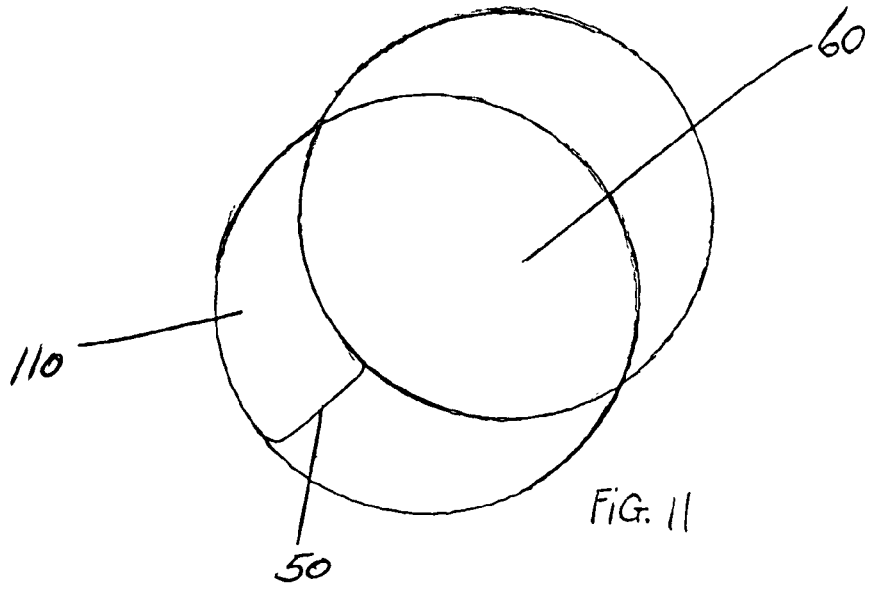
FIG. 11 shows an aerial view of the elastic sleeve.

FIG. 11 shows an aerial view of the sleeve 110) so that you can tell that the band is thin and easy to manipulate over the netting (120) and vessel opening.

Figure 12:
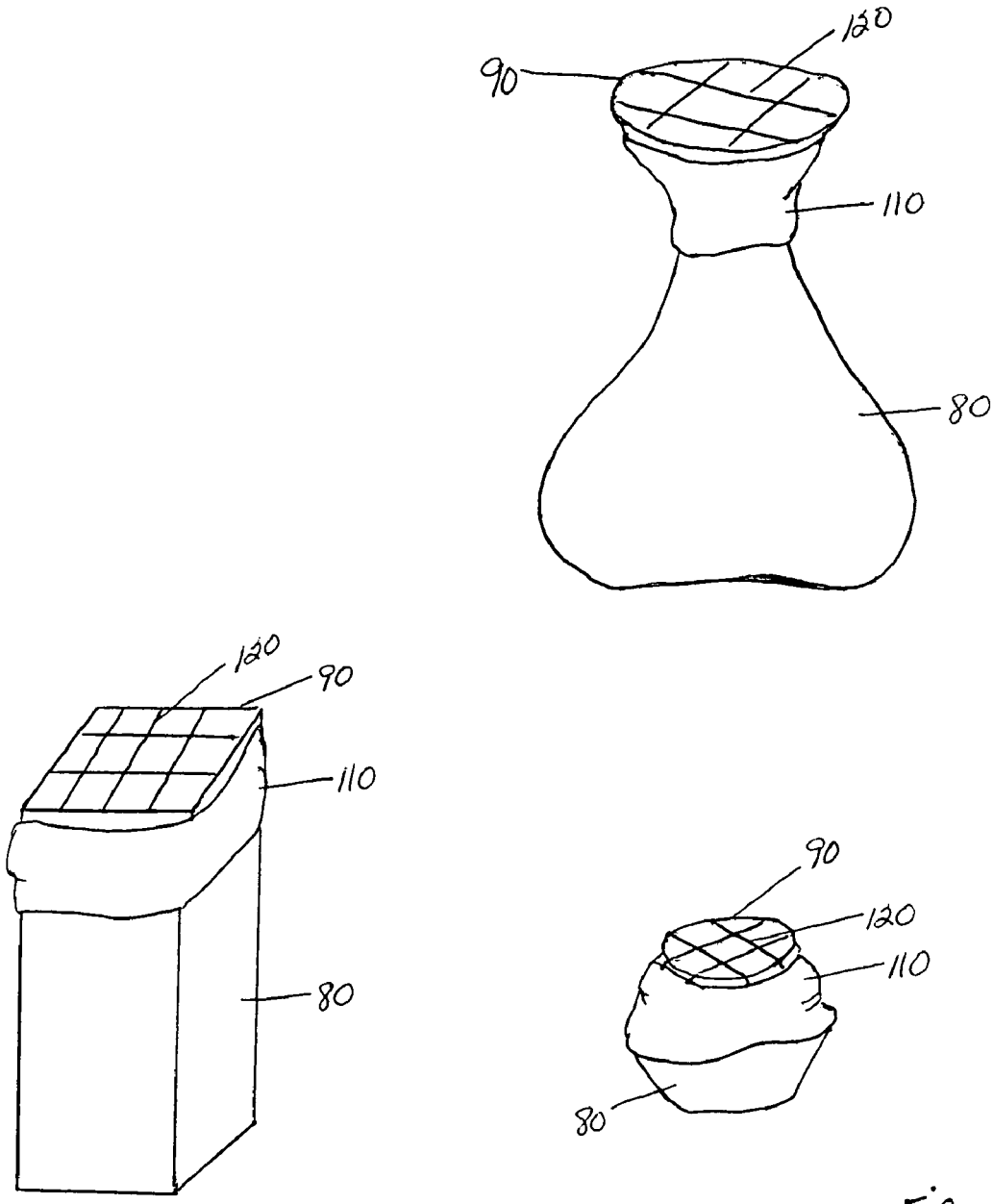
FIG. 12 shows the adaptation of the invention to a variety of shapes, sizes, and styles of vessels.

FIG. 12 shows the potential for the invention to work on a variety of shapes, sizes and styles of containers.

Figure 13:
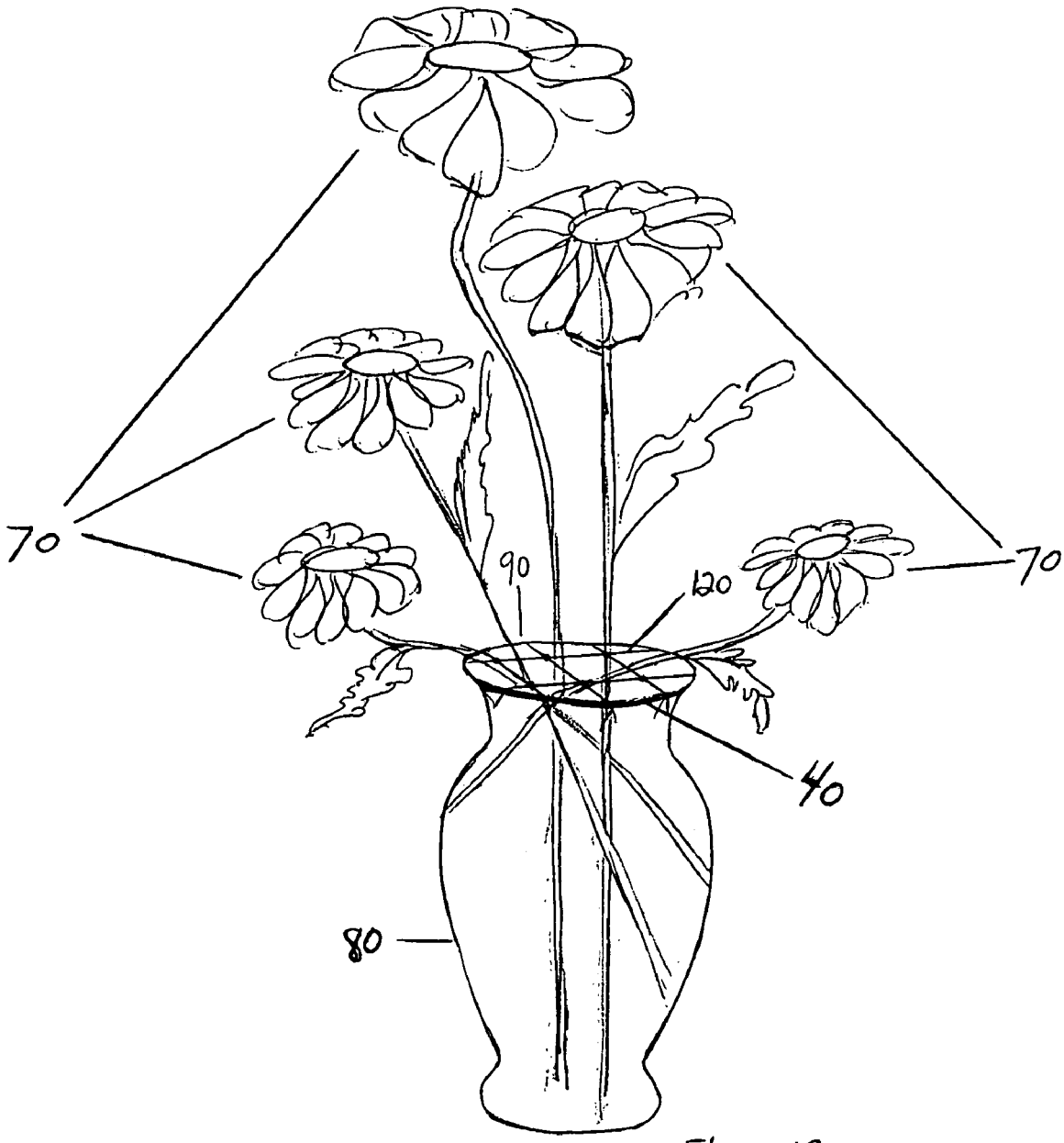
FIG. 13 shows some elements of a floral arrangement being inserted through the grid and into the vase.

In FIG. 13 you can see that the invention can accommodate a variety of elements that make up a floral arrangement (70) and the ability of this method to allow the insertion of floral elements at different angles.

Accordingly the reader will see that this device and method clearly offers the floral industry what it has been longing for. Not only is the system an efficient, economical, adjustable, invisible, durable, deliverable, disposable, waterproof, non-invasive mechanic that surpasses all previous art in this category but the band and the netting can both be used as valuable designing tools in many other capacities in the floristry world. Also, in addition to a clear finish, the plastic netting can be manufactured in many different colors.

It will be understood that the embodiments of the present invention device and method described and illustrated herein are merely exemplary and a person skilled in the art can make many variations to the embodiments shown without departing from the scope of the present invention. All such variations, modifications and alternate embodiments are intended to be included within the scope of the present invention as defined by the appended claims.

I claim:

1. A method for preparing a design of a floral arrangement, wherein said method comprising the sequential steps of:

providing a container has an open mouth of any shape or size, a polypropylene planar top cover containing a plurality of openings that are arranged in a grid pattern of multiple rows and multiple columns wherein said cover has a width and length larger than said opening and wherein said plurality of openings are present in each of said rows and columns, an elastomeric sleeve, an adhesive tape;

placing said cover over said open mouth of said container so as said cover spans over said open mouth with excess material of said cover extends downwardly over said open mouth;

placing said elastomeric sleeve over said open mouth of said container so as said elastomeric sleeve is temporarily engaged and held down said excess material of said cover against an outside peripheral wall of said container;

taping a band of said floral adhesive tape around an outside rim of said open mouth of said container so as to form a tape line below the outside rim and that said excess material of said cover is engaged onto said outside peripheral wall of said container;

removing said elastomeric sleeve from said open mouth of said container so as said elastomeric sleeve can be used again on another container; and trimming away said excess material of said cover below said tape line.

2. The method according to claim 1, further including the step of inserting elements of a floral arrangement through said plurality of openings and into said container.

* * * * *